United States Patent [19]

Witt

[11] 4,084,767

[45] Apr. 18, 1978

[54] TEXTILE BOBBIN WITH YARN END FASTENING MEANS

[75] Inventor: Alan Caywood Witt, Chattanooga, Tenn.

[73] Assignee: E. I. Du Pont de Nemours and Company, Wilmington, Del.

[21] Appl. No.: 783,731

[22] Filed: Apr. 1, 1977

[51] Int. Cl.[2] ..... B65H 55/00; B65H 75/28

[52] U.S. Cl. ..... 242/164; 242/18 EW; 242/35.6 E; 242/125.2

[58] Field of Search ..... 242/164, 159, 170, 171, 242/172, 125, 125.1, 125.2, 125.3, 18 EW, 18 PW, 35.6 E

[56] References Cited

U.S. PATENT DOCUMENTS

| | | | |
|---|---|---|---|
| 299,739 | 6/1884 | Clark | 242/164 X |
| 2,819,853 | 1/1958 | Kozlevcar | 242/125.2 |
| 2,883,124 | 4/1959 | Atwood et al. | 242/118.3 |
| 2,987,267 | 6/1961 | Hayes et al. | 242/125.1 |
| 3,018,973 | 1/1962 | Bradley | 242/125.1 X |
| 3,051,411 | 8/1962 | Atwood et al. | 242/125.1 |
| 3,283,489 | 11/1966 | Bakker | 57/34 R |
| 3,350,032 | 10/1967 | Schewe | 242/164 |
| 3,423,046 | 1/1969 | Bell | 242/164 |

FOREIGN PATENT DOCUMENTS

| | | | |
|---|---|---|---|
| 1,211,855 | 10/1959 | France | 242/125.2 |
| 2,199,742 | 4/1974 | France. | |
| 11,428 of | 1900 | United Kingdom | 242/125.3 |
| 257,118 | 8/1926 | United Kingdom | 242/125.3 |
| 544,117 | 3/1942 | United Kingdom | 242/125.2 |
| 1,264,043 | 2/1972 | United Kingdom. | |

*Primary Examiner*—Stanley N. Gilreath

[57] ABSTRACT

A tubular textile bobbin has yarn wound thereon with an unwound end of yarn extending to one end of the bobbin. A stiff, disc-shaped retainer member removably engages the unwound end of yarn and one end of the bobbin. The unwound yarn end is held in a manner suitable for automatic operations wherein portions of yarn are removed from the package and the loose yarn end is refixed to the bobbin.

3 Claims, 3 Drawing Figures

TEXTILE BOBBIN WITH YARN END FASTENING MEANS

BACKGROUND OF THE INVENTION

1. Field of the Invention

This invention relates to a textile bobbin containing yarn and a means for fastening a yarn end to the bobbin so that it can be easily released and re-fastened.

2. Description of the Prior Art

Continuous filament yarns are commonly wound on a hollow bobbin or pirn during their manufacture. As winding begins, the initial free end of yarn is wrapped around the bobbin and held in place by subsequent layers of yarn. Upon conclusion of winding, the yarn package is transported on a carrier with other yarn packages. The final free ends of the yarn must be fixed in some way to prevent entanglement during transport. The final free end of each yarn preferably is held in a way in which it can be retrieved easily to facilitate removal of a portion of yarn prior to packing for shipment, for example, for product control testing. Also the outer layers of yarn may have become soiled due to handling; stripping of the outer surface removes the soiled yarn.

A common method for fixing such yarn ends for in-house transporting on a carrier is to manually gather the free ends from all yarn packages and wrap them around a post on the carrier. Obviously this does not allow for stripping of yarn from individual packages without entanglement with other ends. This method also is impractical for use in a mechanized system of yarn package transport and testing.

Consequently, there is a need for an improved means for fixing the free end of yarn on each individual package in such a way that a mechanical device can automatically retrieve and fasten the yarn end.

Prior art methods for holding such yarns include forming a wad of yarn and tucking it inside the hollow core or by inserting the yarn in a notch, slit or tab on the end of the bobbin or merely using a piece of pressure sensitive tape to secure the yarn on the surface of the bobbin. Such approaches are not readily adaptable to automatic methods of yarn removal.

SUMMARY OF THE INVENTION

This invention provides, in combination, a tubular textile bobbin having yarn wound thereon with an unwound end of yarn extending to and across one end of the bobbin, and a flat retainer member removably engaging said unwound end of yarn and said one end of bobbin, said member having an opening through which said one end of the bobbin extends, said opening having a diameter relative to the diameter of said one end of the bobbin to enable the member to slidably engage said one end of the bobbin and said unwound end of the yarn extending to said one end of the bobbin to frictionally hold said one end of yarn in a fixed position between said member and said one bobbin end. Preferably, the flat retainer member is of a stiff or relatively rigid construction with said opening being circular and line with a relatively resilient material to facilitate slidable, frictional engagement with said yarn end and said bobbin end.

BRIEF DESCRIPTION OF THE DRAWINGS

FIG. 1 shows one end of a conventional package of yarn 10 wound on a bobbin 12 having unwound yarn end 14 extending to the end of bobbin 12. A flat retainer member 16 in the form of a disc removably engages yarn end 14 and the end of bobbin 12. Retainer member 16 has an opening 18 through which the end of bobbin 12 extends. Opening 18 is lined with a resilient material in the form of an annular insert 20. Annular insert 20 enables retainer member 16 to slidably engage bobbin 12 and to frictionally hold yarn end 14 in a fixed position between said member and said bobbin end.

In operation, when a yarn package is being removed from a winding machine such as following spinning or drawing, the end of yarn is led from the wound package across one end of the bobbin. The retainer member is then passed over the end of the bobbin thus engaging the end and trapping the loose end of yarn between the bobbin surface and the retainer member. The retainer member frictionally engages the end of the bobbin so as to remain in a fixed position permitting the bobbin to be handled and transported without the yarn becoming unwound.

Figure 1:
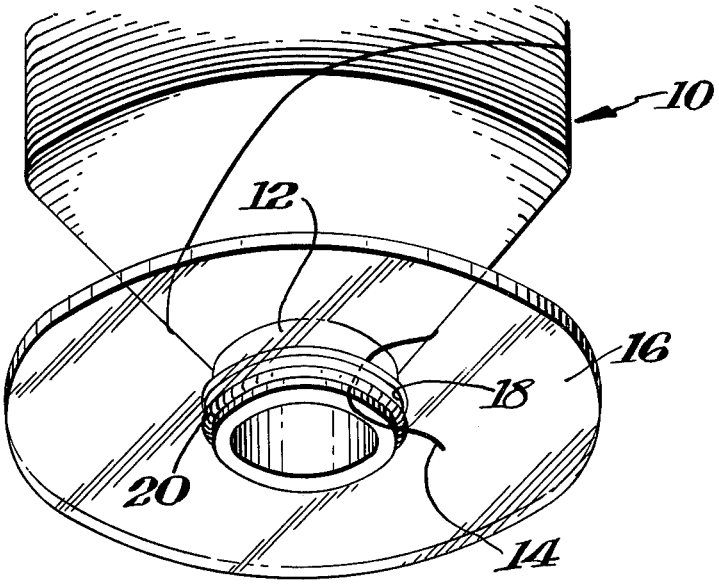
FIG. 1 is a perspective view of the end of a yarn package having a yarn end held on the end of the bobbin by a disc-shaped member according to the invention.
Figure 2:
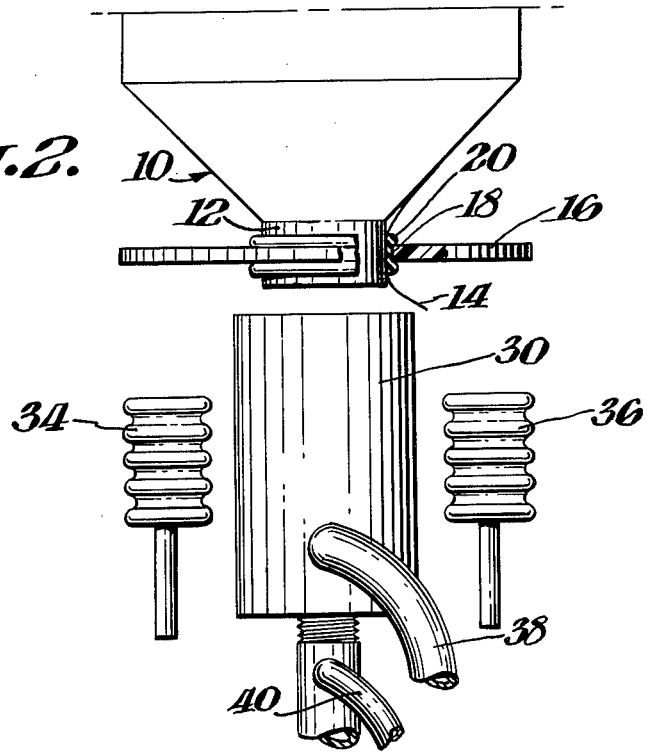
FIG. 2 is a plan view of three sections of an apparatus for mechanically removing and replacing the disc member of FIG. 1.

An apparatus embodying sections as shown in part in FIG. 2 can be used to mechanically remove yarn from the package shown in FIG. 1. The apparatus includes a nozzle 30 containing a central yarn stripper jet (shown in greater detail in FIG. 3) positioned between two molded rubber suction cups 34, 36 for engaging retainer member 16. Nozzle 30 has an outside diameter which matches with the outside diameter of bobbin 12. Suction cups 34, 36 are connected to a vacuum source (not shown). Nozzle 30 is provided with a vacuum source via pipe 38 and an air supply source via pipe 40 for stripper jet 32 contained within nozzle 30.

Figure 3:
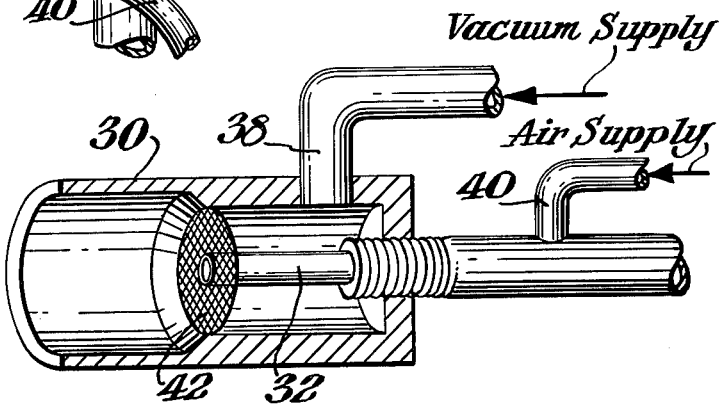
FIG. 3 is a side elevation in partial section of the central-most section of FIG. 2, which is a nozzle for engaging the end of the yarn of FIG. 1 for stripping yarn from the bobbin when the yarn has been released by removal of the disc member.

FIG. 3 shows a side elevation in partial section of nozzle 30. Annular screen 42 allows the yarn to enter stripper jet 32 without being picked up by vacuum source pipe 38. In operation, the apparatus is positioned adjacent the end of a bobbin having a loose yarn end held in place by a flat retainer member as shown in FIG. 1. Nozzle 30 is axially aligned with the end of the bobbin and moved to within about ⅛ inch (0.3 cm.) of the end of the bobbin. Suction cups 34, 36 are caused to contact the flat surface of retainer member 16 and vacuum applied to the cups causing them to firmly attach to the retainer member. Suction cups 34, 36 are then retracted thus pulling the retainer member off the end of the bobbin and over the end of the nozzle 30. The loose yarn end 14 is thereby released and drawn toward stripper jet 32 facilitated by air flowing towards the reduced air pressure provided by vacuum source 38. Open stripper jet 32 centered in screen 42 picks up the yarn end and the stripping of yarn from the package begins. The vacuum source to the nozzle 30 is then shut off. Stripper jet 32 operates as a conventional yarn stripping device or "sucker gun". A pressurized air venturi connected to stripper jet 32 is used for low or high speed stripping as controlled by the pressure applied. After stripping begins, the nozzle may be retracted the necessary distance from the bobbin end to facilitate stripping without sloughing of multiple yarn layers from the package surface. When the desired amount of yarn has been removed from the package, the sequence of events is reversed in order to refasten the yarn to the end of the bobbin. Suction cups 34, 36 are caused to push retainer member 16 back onto the end of bobbin 12 again trapping yarn end 14 between bobbin 12 and the resilient lining of opening 18 in retainer member 16. The vacuum to the suction cups is cut off and the cups retracted leaving the retainer member 16 on the bobbin. The yarn is severed between the bobbin and the nozzle 30.

In practice, the nozzle and the suction cups may be actuated mechanically, pneumatically or manually. The sequence of movement may be controlled automatically. A series of the devices may be ganged to operate simultaneously on a plurality of bobbins.

Suitable retainer members can be constructed from a ⅛ inch (3.175 mm.) thick sheet of poly(methylmethacrylate), polycarbonate, or other plastic, and provided with an opening, for example, ¼ inch (6.35 mm.) larger in diameter than the outside diameter of the bobbin end with which it is to be used. The opening is provided with an insert made of silicone rubber 1/16 inch thick (1.588 mm.) with the insert having an opening ⅛ inch (3.175 mm.) less in diameter than the bobbin end. Other similar rubber materials may be used including natural and poly(chloroprene) and styrene/butadiene based rubbers. These dimensions allow for some minor misalignment between the bobbin end and the nozzle. It is necessary that the insert be able to stretch or flex within the necessary limits of accuracy in alignment.

Where it is desirable for the end of the yarn package to be clearly visible for inspection or identification purposes, it is preferred that a clear plastic material be used for the retainer member. Where transparency of the retainer is not important, a less expensive material may be used, for example, even a die-cut cardboard with radial slits around the opening which would permit engagement with the bobbin end. Such an item could be sufficiently economical as to be disposable and could be left in place on the bobbin during shipment.

The retainer member is preferably a reuseable rigid plastic disc having a resilient insert held in place, for example, by a groove molded into the inner periphery of the opening to allow and facilitate replacement of the insert as needed. The retainer member must be sufficiently rigid to insure proper seating of the insert on the bobbin in use and to permit proper engagement by an automatic removal mechanism such as suction cups mounted on moveable rods. Precise perpendicular alignment of the retainer member with the bobbin axes is not essential but the member should maintain full contact around the bobbin end.

By this invention, the loose yarn end is firmly fixed on the end of the yarn package but is easily retrieved for subsequent operations. The method is not dependent on the diameter of the yarn package. There are no projections or adhesive residues left on the end of the bobbin which might cause difficulty in subsequent yarn removal operations or handling. The package and handling method are highly suited for automatic operation. Controlled lengths of yarn can be removed, for example for denier or dyeability analysis, by controlling the air supply to the stripper jet and the length of time for which yarn is removed from the package.

What is claimed is:

1. In combination, a tubular textile bobbin having yarn wound thereon with an unwound end of yarn extending to one end of the bobbin, and a rigid disc having a flat surface substantially normal to the axis of the tubular bobbin extending substantially beyond the peripheral surface of said bobbin said disc having a central opening through which said one end of the bobbin and said unwound end of yarn extends, said opening having a diameter relative to the diameter of said one end of the bobbin to enable the disc to slidably engage said one end of the bobbin and said unwound end of yarn extending to said one end of the bobbin to frictionally hold said unwound end of yarn in a fixed position between said disc and said one end.

2. The combination as defined in claim 1, said opening being circular and lined with a resilient material, said material slidably and frictionally engaging said unwound end of yarn and said one end of the bobbin.

3. The combination as defined in claim 2, said disc being comprised of a rigid, transparent plastic material.

* * * * *